US010738458B2

(12) United States Patent
Matsuoka

(10) Patent No.: US 10,738,458 B2
(45) Date of Patent: Aug. 11, 2020

(54) EXTENDABLE ARM STRUCTURE

(71) Applicant: FUJIMIYASEISAKUSHO CO., LTD., Kumamoto (JP)

(72) Inventor: Norimichi Matsuoka, Kumamoto (JP)

(73) Assignee: FUJIMIY ASEISAKUSHO CO., LTD., Kumamoto (JP)

( * ) Notice: Subject to any disclaimer, the term of this patent is extended or adjusted under 35 U.S.C. 154(b) by 0 days.

(21) Appl. No.: 16/227,255

(22) Filed: Dec. 20, 2018

(65) Prior Publication Data

US 2019/0316343 A1 Oct. 17, 2019

(30) Foreign Application Priority Data

Apr. 17, 2018 (JP) ..... 2018-078965

(51) Int. Cl.
*E04B 1/34* (2006.01)
*E04H 12/18* (2006.01)
(Continued)

(52) U.S. Cl.
CPC ..... *E04B 1/3441* (2013.01); *E04H 12/187* (2013.01); *E04F 10/10* (2013.01);
(Continued)

(58) Field of Classification Search
CPC ..... E04B 1/343; E04B 1/344; E04B 1/3441; E04H 1/1244; E04H 9/16; E04H 12/187;
(Continued)

(56) References Cited

U.S. PATENT DOCUMENTS 2,321,507 A 6/1943 Oberdorfer et al.
3,074,079 A * 1/1963 Isaacson ..... E04H 4/10 4/500
RE31,565 E * 4/1984 Beaulieu ..... E04H 15/50 135/145
9,153,860 B2 * 10/2015 Tserodze ..... H01Q 15/161
9,840,837 B1 * 12/2017 Matsuoka ..... E04B 1/19
10,006,195 B2 * 6/2018 Matsuoka ..... A01K 1/03
10,267,031 B2 * 4/2019 Matsuoka ..... A63H 33/00
(Continued)

FOREIGN PATENT DOCUMENTS

AU 2009100180 A4 3/2009
DE 1784874 1/1972
(Continued)

OTHER PUBLICATIONS

Extended European Search Report issued in corresponding Application No. 18212278.8 dated Jul. 3, 2019, pp. 1-8, European Patent Office, Munich, Germany.

*Primary Examiner* — Ryan D Kwiecinski
(74) *Attorney, Agent, or Firm* — Hauptman Ham, LLP

(57) ABSTRACT

An extendable arm structure includes: an upper extendable arm and a lower extendable arm which extend parallel in a same direction; and a vertical coupling member that couples the upper and lower extendable arms. Each of the extendable arms includes a plurality of X-shaped cross units each formed by pivotally coupling two rigid members via a middle coupling shaft, and two end coupling shafts that pivotally couple ends of adjacent ones of the cross units. The extendable arm structure further includes: a planar member that closes, in a planar fashion, a space between the rigid member of the upper extendable arm and the rigid member of the lower extendable arm which extends parallel to the rigid member of the upper extendable arm in a same direction.

9 Claims, 16 Drawing Sheets

(51) Int. Cl.

| | |
|---|---|
| ***E04H 15/50*** | (2006.01) |
| ***E04F 10/10*** | (2006.01) |
| ***E06B 9/06*** | (2006.01) |
| ***G09F 15/00*** | (2006.01) |
| ***E04B 1/344*** | (2006.01) |

(52) U.S. Cl.
CPC ..... *E04H 15/50* (2013.01); *E06B 9/0638* (2013.01); *E06B 9/0661* (2013.01); *E06B 9/0669* (2013.01); *E06B 9/0676* (2013.01); *G09F 15/0062* (2013.01); *G09F 15/0068* (2013.01)

(58) Field of Classification Search
CPC ..... E04H 15/44; E04H 15/48; E04H 15/50; E04H 17/18; E04F 10/0629; E04F 10/10; E06B 9/0661; E06B 9/0669; E06B 9/0638; E06B 9/0676; G09F 15/0062; G09F 15/0068
See application file for complete search history.

(56) References Cited

U.S. PATENT DOCUMENTS

| | | | | |
|---|---|---|---|---|
| 2003/0074845 | A1* | 4/2003 | Sample | E04H 15/42 52/63 |
| 2015/0300560 | A1* | 10/2015 | Matsuoka | A63H 33/00 362/427 |
| 2016/0319985 | A1* | 11/2016 | Matsuoka | A63H 33/00 |
| 2018/0051458 | A1* | 2/2018 | Matsuoka | F16S 3/08 |
| 2018/0155922 | A1* | 6/2018 | Matsuoka | E04C 3/02 |
| 2019/0316343 | A1* | 10/2019 | Matsuoka | E04B 1/3441 |

FOREIGN PATENT DOCUMENTS

| | | | | |
|---|---|---|---|---|
| JP | 2014159070 | A | 9/2014 | |
| JP | 2016211617 | A | 12/2016 | |
| JP | 2018025212 | A | 2/2018 | |
| JP | 2018031391 | A | 3/2018 | |
| WO | WO-9105921 | A1 * | 5/1991 | E04B 1/3441 |
| WO | WO-2006106168 | A1 * | 10/2006 | E04H 15/18 |
| WO | WO-2013135298 | A1 * | 9/2013 | H01Q 1/288 |

* cited by examiner

EXTENDABLE ARM STRUCTURE

BACKGROUND OF THE INVENTION

Field of the Invention

The present invention relates to extendable arm structures whose shape can be changed with extending and contracting movement of extendable arms.

Background Art

The applicant of the present application has filed some patent applications for extendable arm structures whose shape can be changed with extending and contracting movement of extendable arms.

Japanese Unexamined Patent Application Publication No. 2014-159070 (Patent Literature 1) discloses an extendable arm formed by arranging a plurality of X-shaped cross units in one direction and pivotally coupling the cross units.

Japanese Patent No. 5,996,713 (Patent Literature 2) discloses a variable area frame whose area can be changed with extending and contracting movement of extendable arms and a variable volume three-dimensional structure whose volume can be changed with extending and contracting movement of extendable arms.

Japanese Unexamined Patent Application Publication No. 2018-25212 (Patent Literature 3) discloses a variable shape three-dimensional structure whose shape can be changed with extending and contracting movement of extendable arms.

Japanese Unexamined Patent Application Publication No. 2018-31391 (Patent Literature 4) discloses a variable shape frame whose shape can be changed with extending and contracting movement of extendable arms.

Patent Literature 1: Japanese Unexamined Patent Application Publication No. 2014-159070

Patent Literature 2: Japanese Patent No. 5,996,713

Patent Literature 3: Japanese Unexamined Patent Application Publication No. 2018-25212

Patent Literature 4: Japanese Unexamined Patent Application Publication No. 2018-31391

SUMMARY OF INVENTION

The inventors further considered more effective use of extendable arms and found that extendable arm structures with higher use value are implemented by combining an extendable arm and a planar member.

It is an object of the present invention to provide an extendable arm structure with high use value.

An extendable arm structure according to the present invention includes: an upper extendable arm and a lower extendable arm which extend parallel in a same direction; and a vertical coupling member that couples the upper and lower extendable arms. Each of the extendable arms includes a plurality of X-shaped cross units each formed by pivotally coupling two rigid members via a middle coupling shaft, and two end coupling shafts that pivotally couple ends of adjacent ones of the cross units. The extendable arm structure further includes: a planar member that closes, in a planar fashion, a space between the rigid member of the upper extendable arm and the rigid member of the lower extendable arm which extends parallel to the rigid member of the upper extendable arm in a same direction.

In one embodiment, the vertical coupling member couples the middle coupling shafts or the end coupling shafts of the upper and lower extendable arms.

In one embodiment, the vertical coupling member includes a middle coupling bar that couples the middle coupling shafts of the upper and lower extendable arms, and two end coupling bars that couple the two end coupling shafts of the upper and lower extendable arms. The planar member is a flexible sheet material that extends in a zigzag pattern in a longitudinal direction of the extendable arms so as to be bent outward at a position of the end coupling bar located on one side and bent inward at a position of the middle coupling bar.

In one embodiment, the rigid members that form the cross unit include a first rigid member and a second rigid member, and the planar member connects an entire length of the second rigid member of the upper extendable arm and an entire length of the second rigid member of the lower extendable arm in a planar fashion.

In one embodiment, the vertical coupling member couples the upper and lower extendable arms at a variable interval therebetween. For example, the vertical coupling member is formed by arranging a plurality of X-shaped cross units in a vertical direction and coupling the plurality of X-shaped cross units. In another form, the vertical coupling member includes a bent unit having a first bent rigid member bent in a V-shape, a second bent rigid member bent in a V-shape that opens in an opposite direction from the V-shape of the first bent rigid member, and a bend part coupling shaft that pivotally couples a bend part of the first bent rigid member and a bend part of the second bent rigid member.

In the case of the extendable arm structure in which the interval between the upper extendable arm and the lower extendable arm is variable, the planar member has a variable vertical height. In order for the planar member to have a variable vertical height, the planar member is, e.g., a single flexible sheet material. In another form for the planar member to have a variable vertical height, the planar member is formed by, e.g., a plurality of plate materials, and the plurality of plate materials are configured so that the plurality of plate materials can be located at a folded position where the plurality of plate materials overlap each other and a deployed position where the plurality of plate materials are connected on a same plane.

In one embodiment, the extendable arm structure further includes: an upper frame formed by coupling ends of a plurality of the upper extendable arms; and a lower frame formed by coupling ends of a plurality of the lower extendable arms.

In one embodiment, the extendable arm structure further includes: an upper circular frame formed by coupling both ends of the upper extendable arm; and a lower circular frame formed by coupling both ends of the lower extendable arm.

In one embodiment, the extendable arm structure further includes: an upper circular frame formed by coupling both ends of the upper extendable arm; and a lower circular frame formed by coupling both ends of the lower extendable arm, and the planar member is a cylindrical member disposed between the upper circular frame and the lower circular frame and having a variable circumferential length.

The invention with the above configuration thus provides an extendable arm structure with high use value.

BRIEF DESCRIPTION OF DRAWINGS

FIG. 27A shows three plate materials completely overlapping each other, FIG. 27B shows the three plate materials partially overlapping each other, and FIG. 27C shows the three plate materials connected on the same plane.

DESCRIPTION OF EMBODIMENTS

Figure 1:
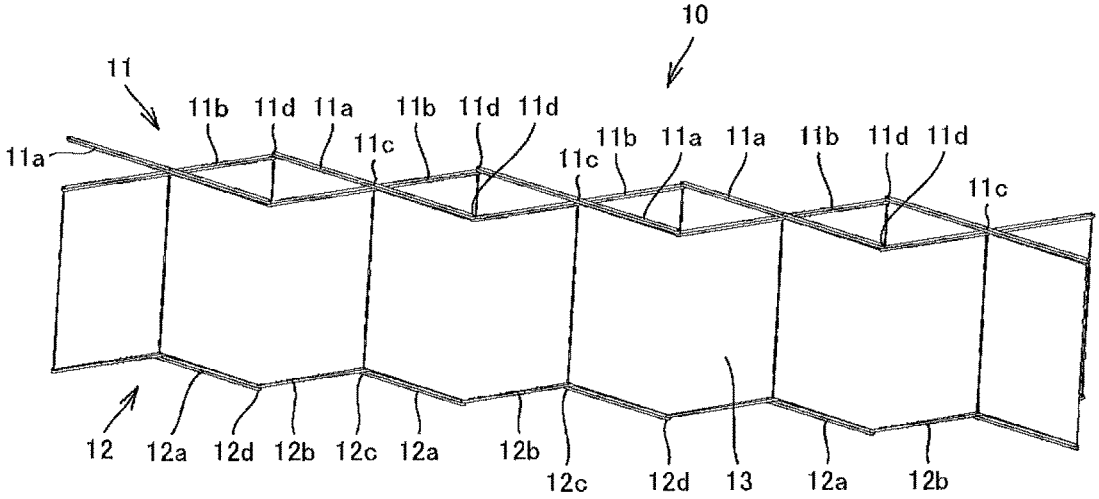
FIG. 1 is a perspective view of an embodiment of an extendable arm structure.

Some embodiments will be described by way of example in order to explain features of the present invention. In each embodiment, elements having the same or similar function are denoted with the same reference characters and repetitive description may be omitted.

Figure 2:
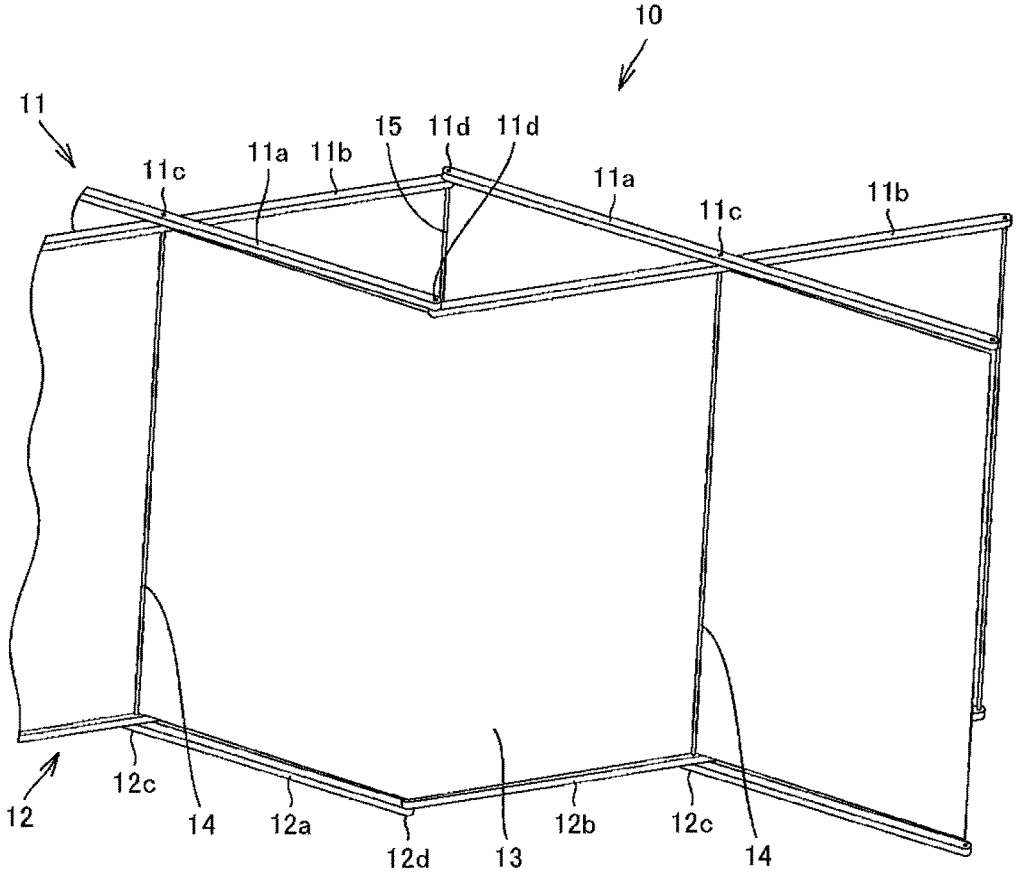
FIG. 2 is a partial enlarged perspective view of the extendable arm structure shown in FIG. 1.
Figure 3:
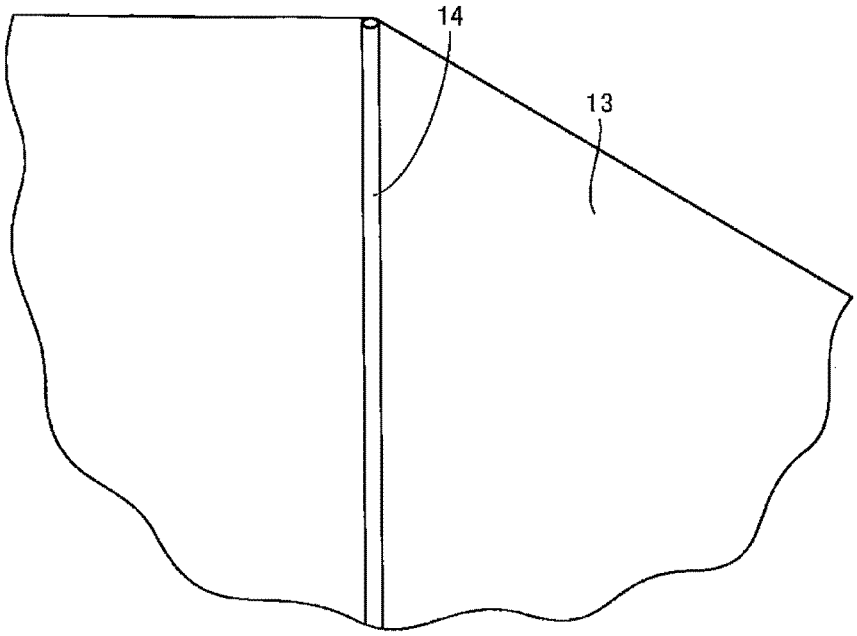
FIG. 3 is a perspective view of an inwardly bent part of a planar member.

FIGS. 1 to 3 show an extendable arm structure according to an embodiment of the present invention. An extendable arm structure 10 includes an upper extendable arm 11, a lower extendable arm 12, and a vertical coupling member. The upper and lower extendable arms 11, 12 extend parallel in the same direction, and the vertical coupling member couples the upper and lower extendable arms.

The upper extendable arm 11 includes a plurality of X-shaped cross units and two end coupling shafts 11*d*. Each cross unit is formed by pivotally coupling a first rigid member 11*a* and a second rigid member 11*b* via a middle coupling shaft 11*c*. The end coupling shafts 11*d* pivotally couple the ends of adjacent ones of the cross units. Similarly, the lower extendable arm 12 includes a plurality of X-shaped cross units and two end coupling shafts 12*d*. Each cross unit is formed by pivotally coupling a first rigid member 12*a* and a second rigid member 12*b* via a middle coupling shaft 12*c*. The end coupling shafts 12*b* pivotally couple the ends of adjacent ones of the cross units.

As can be seen from FIGS. 2 and 3, the vertical coupling member includes a middle coupling bar 14 and two end coupling bars 15. The middle coupling bar 14 couples the middle coupling shafts 11*c*, 12*c* of the upper and lower extendable arms 11, 12. Each end coupling bar 15 couples the end coupling shafts 11*d*, 12*d* of the upper and lower extendable arms 11, 12.

The extendable arm structure 10 further includes a planar member 13. The planar member 13 closes, in a planar fashion, the space between the rigid members 11*a*, 11*b* of the upper extendable arm 11 and the rigid members 12*a*, 12*b* of the lower extendable arm 12 which extend parallel to the rigid members 11*a*, 11*b* of the upper extendable arm 11. In the illustrated embodiment, the planar member 13 is a single flexible sheet material that extends in a zigzag pattern in the longitudinal direction of the extendable arms 11, 12 so as to be bent outward at the position of the end coupling bar 15 located on one side and bent inward at the position of the middle coupling bar 14. Specifically, the planar member 13 is bent inward in contact with the outer peripheral surface of the middle coupling bar 14 and is bent outward in contact with the outer peripheral surface of the end coupling bar 15. The bend angle of the planar member 13 changes with expanding and contracting movement of the upper and lower extendable arms 11, 12.

In the embodiment shown in FIGS. 1 to 3, the planar member 13 is located only on one side (in the figures, on the side closer to the viewer) of inward bending points, namely the idle coupling shafts 11*c*, 12*c* of the upper and lower extendable arms 11, 12.

Figure 4:
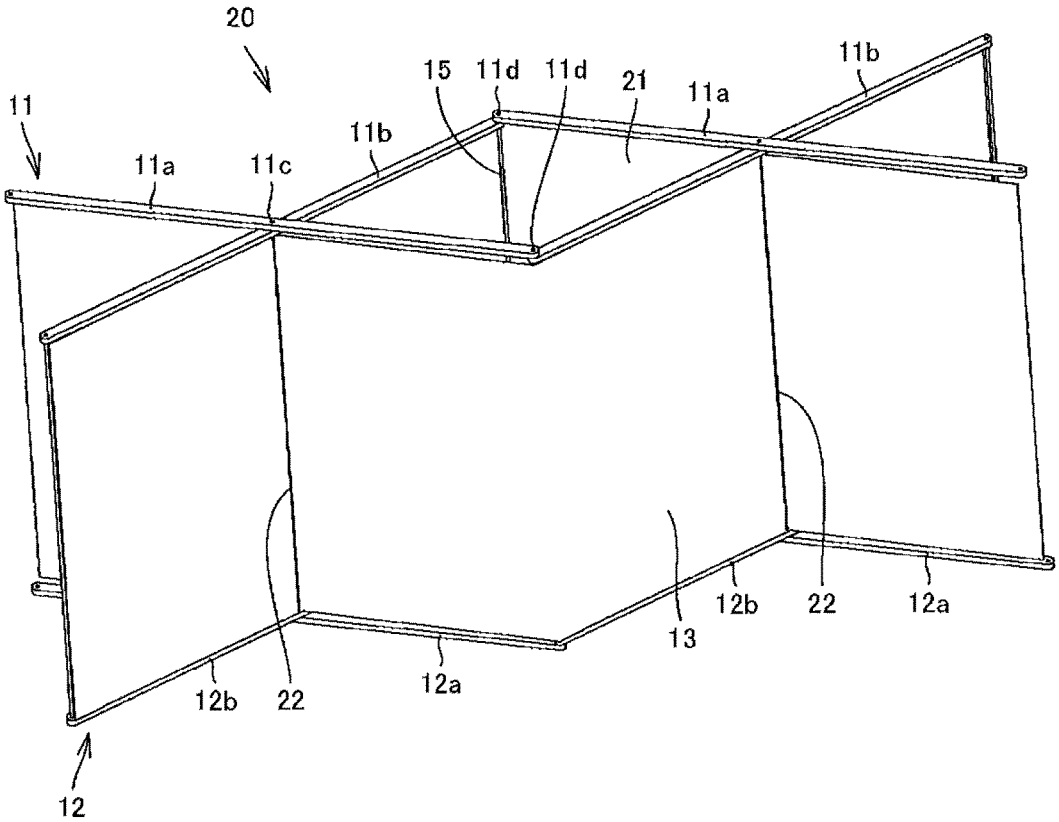
FIG. 4 is a perspective view of another embodiment of the extendable arm structure.
Figure 5:
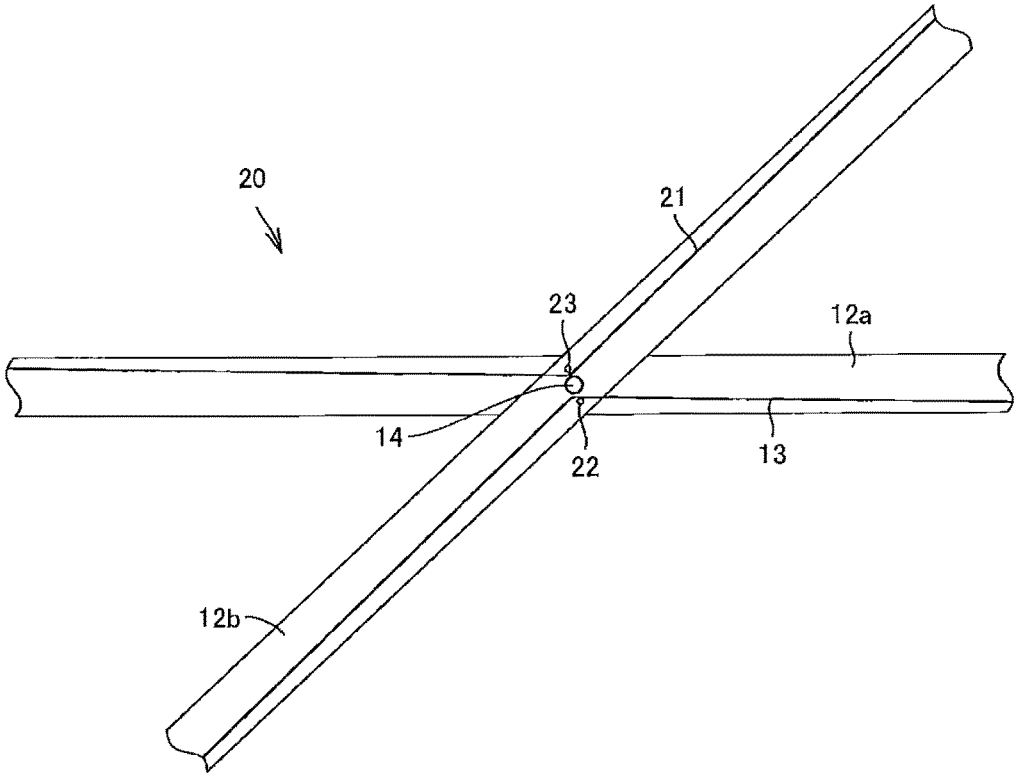
FIG. 5 is a perspective view of inwardly bent parts of planar members.

An extendable arm structure 20 according to an embodiment shown in FIGS. 4 and 5 includes two planar members 13, 21. As shown in FIG. 5, the extendable arm structure 20 includes two shaft bars 22, 23 near each middle coupling bar 14. The planar member 13 located on one side, namely on the side closer to the viewer, is a flexible sheet material that extends in a zigzag pattern in the longitudinal direction of the extendable arms 11, 12 so as to be bent outward in contact with the outer peripheral surface of the end coupling bar 15 located on the one side and bent inward in contact with the outer peripheral surface of the shaft bar 22 located on the one side. The planar member 13 located on the other side, namely on the side farther away from the viewer, is a flexible sheet material that extends in a zigzag pattern in the longitudinal direction of the extendable arms 11, 12 so as to be bent outward in contact with the outer peripheral surface of the end coupling bar 15 located on the other side and bent inward in contact with the outer peripheral surface of the shaft bar 23 located on the other side.

Figure 6:
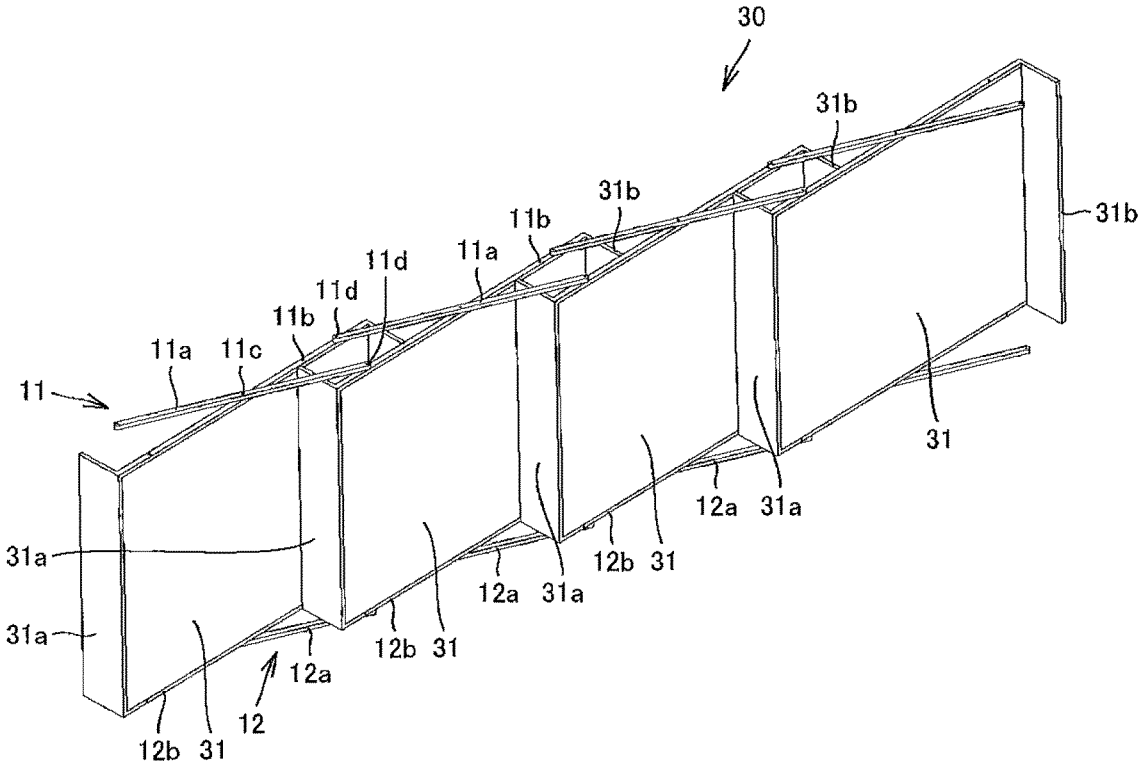
FIG. 6 is a perspective view of still another embodiment of the extendable arm structure.
Figure 7:
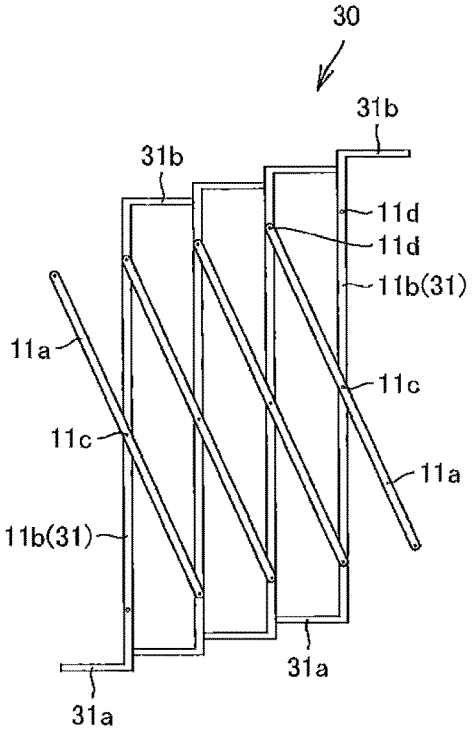
FIG. 7 is a perspective view of the extendable arm structure of FIG. 6 in a contracted state.

FIGS. 6 and 7 show an extendable arm structure 30 according to still another embodiment. FIG. 6 shows the extendable arm structure 30 in a fully extended state, and FIG. 7 shows the extendable arm structure 30 in a fully collapsed state. In the illustrated embodiment, each planar member 31 connects the entire length of the second rigid member 11*b* of the upper extendable arm 11 and the entire length of the second rigid member 12*b* of the lower extendable arm 12 in a planar fashion. The planar member 31 is, e.g., a rigid plate material or a rigid quadrilateral frame with a sheet material fitted therein, and is integral with the upper and lower second rigid members 11*b*, 12*b*.

In the deployed state shown in FIG. 6 and the contracted state shown in FIG. 7, each planar member 31 has a bent front end 31*a* and a bent rear end 31*b* in order to close the clearance between adjacent ones of the planar members 31. The bent front end 31*a* is formed by bending the front end of the planar member 31, and the bent rear end 31*b* is formed by bending the rear end of the planar member 31. The bent front end 31*a* and the bent rear end 31*b* are bent in opposite directions. When the extendable arm structure 30 is in the deployed state and in the contracted state, the bent front end 31*a* of each planar member 31 contacts a planar portion of an adjacent planar member 31 located closer to the front of the extendable arms 11, 12 in the longitudinal direction of the extendable arms 11, 12, and closes the clearance between these two planar members 31. The bent rear end 31*b* of each planar member 31 contacts a planar portion of an adjacent planar member 31 located closer to the rear of the extendable arms 11, 12 in the longitudinal direction of the extendable arms 11, 12, and closes the clearance between these two planar members 31.

FIGS. 8 to 12 show an extendable arm structure 40 according to yet another embodiment. In the embodiments shown in FIGS. 1 to 7, the first rigid members 11*a*, 12*a* and the second rigid members 11*b*, 12*b*, which are components of the cross units, have a linear shape. On the other hand, rigid members, which are components of cross units of the extendable arm structure 40 shown in FIGS. 8 to 12, have a curved shape.

The extendable arm structure 40 shown in FIGS. 8 to 12 includes upper curved rigid members 43 located at upper positions, intermediate curved rigid members 44 located at intermediate positions, and lower curved rigid members 45 located at lower positions. Each curved rigid member 43, 44, 45 has a curved shape with both end coupling shafts 11*d* being offset to one side with respect to a longitudinal axis passing through the middle coupling shaft 11*c*. Each curved rigid member 43, 44, 45 may be formed by a rigid quadrilateral plate material or may be formed by a rigid quadrilateral frame. In the case where a quadrilateral frame is used, a sheet material, glass, etc. may be fitted in the frame.

A cross-link is formed by the upper and lower curved rigid members 43, 45 that are pivotally coupled via the middle coupling shaft 11*c*. In the illustrated embodiment, the plurality of upper curved rigid members 43 and the plurality of intermediate curved rigid members 44 form an upper extendable arm 41, and the plurality of intermediate curved rigid members 44 and the plurality of lower curved rigid members 45 form a lower extendable arm 42. The intermediate curved rigid members 44 serve as planar members that close the space between the upper and lower extendable arms 41, 42. In terms of shape, all of the curved rigid members 43, 44, 45 are planar members.

Since the upper and lower extendable arms 41, 42 are formed by using the curved rigid members, the extendable arms 41, 42 extend and contract in a curved path. An upper circular frame and a lower circular frame can be formed by increasing the number of curved rigid members 43, 44, 45, coupling both ends of the upper extendable arm 41, and coupling both ends of the lower extendable arm 42.

Figure 8:
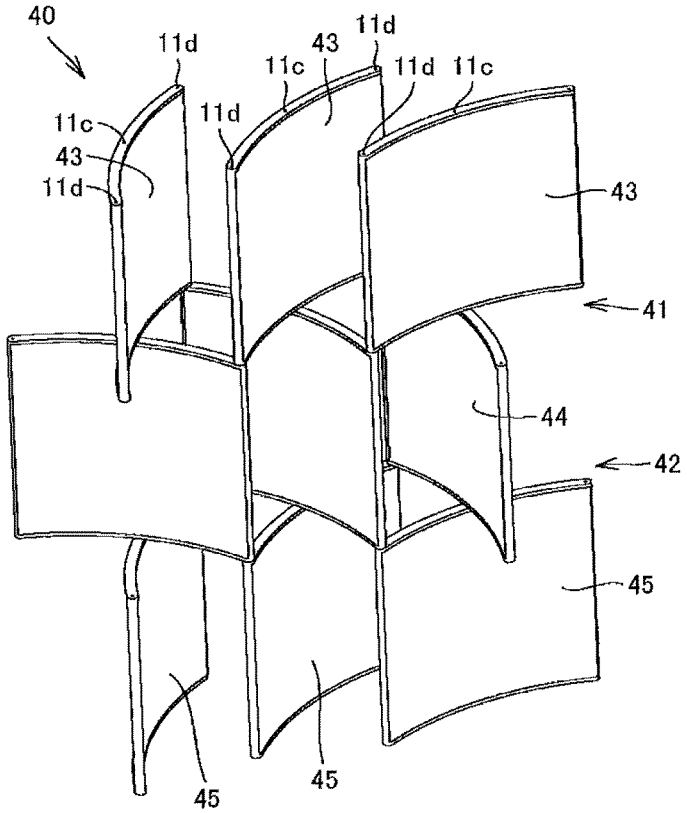
FIG. 8 is a perspective view of yet another embodiment of the extendable arm structure.
Figure 9:
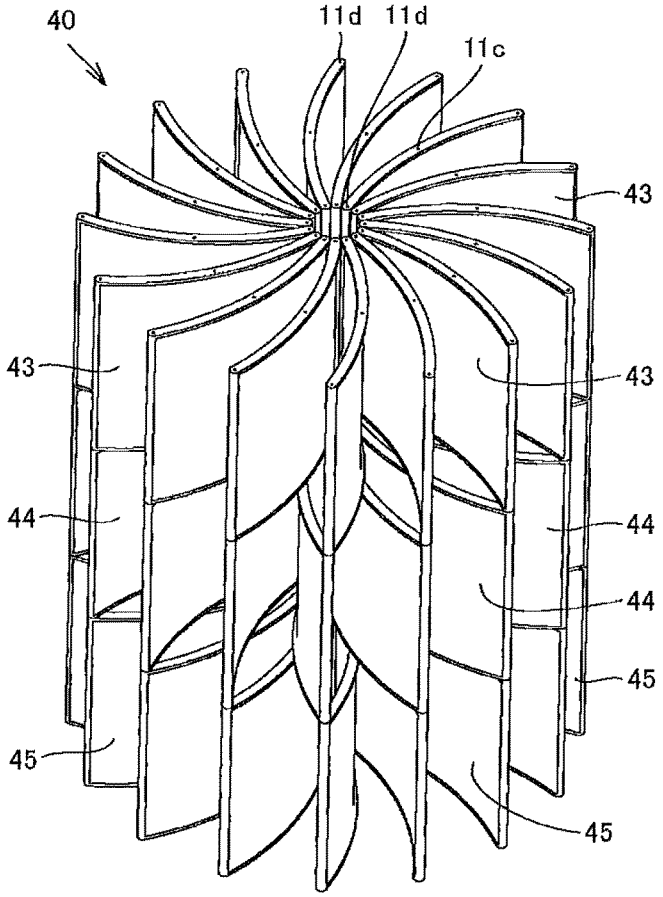
FIG. 9 is a perspective view of a cylindrical extendable arm structure formed by coupling both ends of the extendable arm structure shown in FIG. 8.
Figure 10:
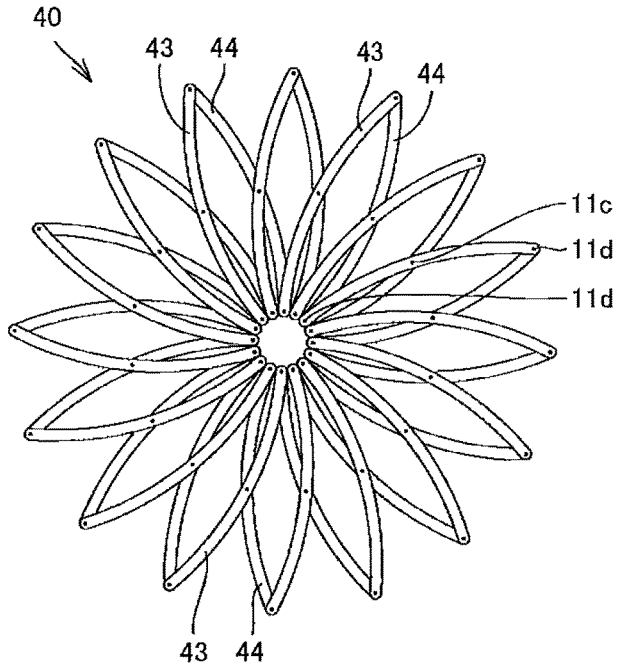
FIG. 10 is a plan view of the cylindrical extendable arm structure shown in FIG. 9.
Figure 11:
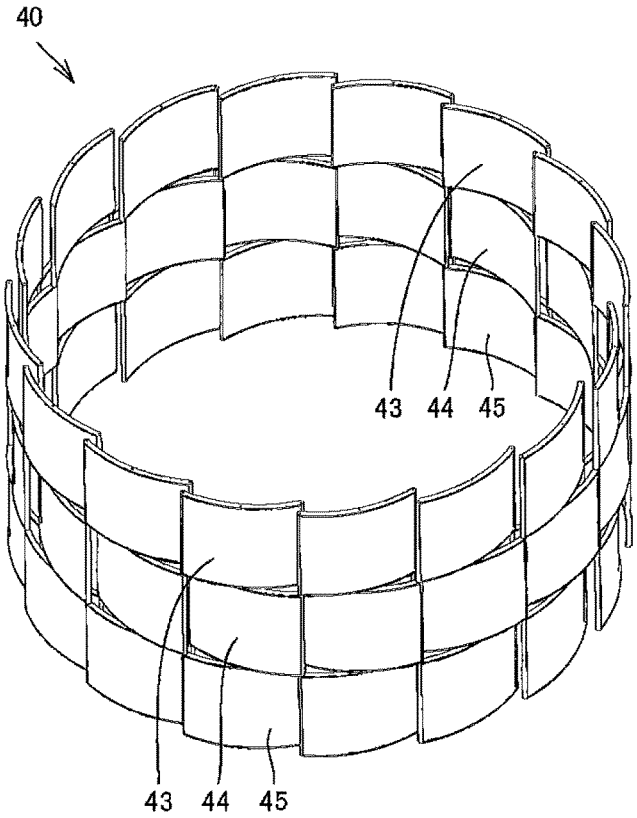
FIG. 11 is a perspective view of the cylindrical extendable arm structure of FIG. 9 in a fully extended state.
Figure 12:
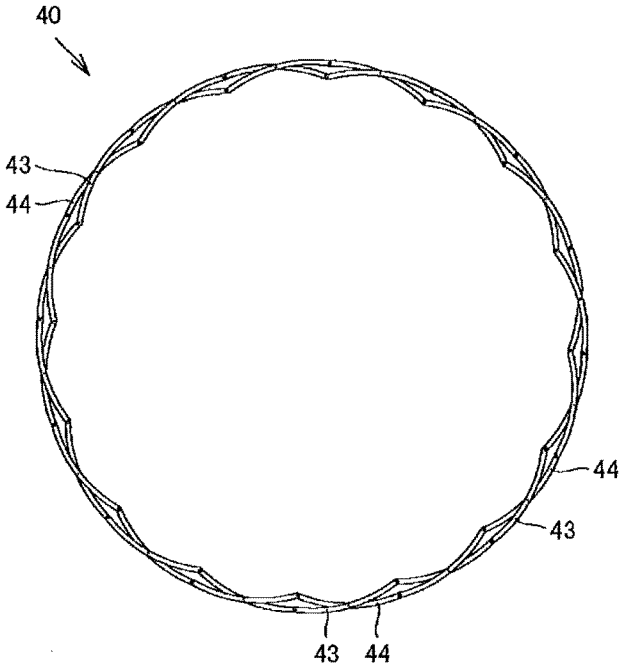
FIG. 12 is a plan view of the cylindrical extendable arm structure shown in FIG. 11.

FIGS. 9 to 12 show a cylindrical extendable arm structure formed by coupling both ends of the extendable arm structure shown in FIG. 8. FIG. 9 is a perspective view of the cylindrical extendable arm structure in a fully collapsed state, and FIG. 10 is a plan view thereof. FIG. 11 is a perspective view of the cylindrical extendable arm structure in a fully extended state, and FIG. 12 is a plan view thereof. As can be seen from these figures, a columnar space surrounded by a cylindrical surface (FIGS. 11, 12) can be formed by using planar members that are curved in the lateral direction as the rigid members 43, 44, 45 that form the extendable arms.

Figure 13:
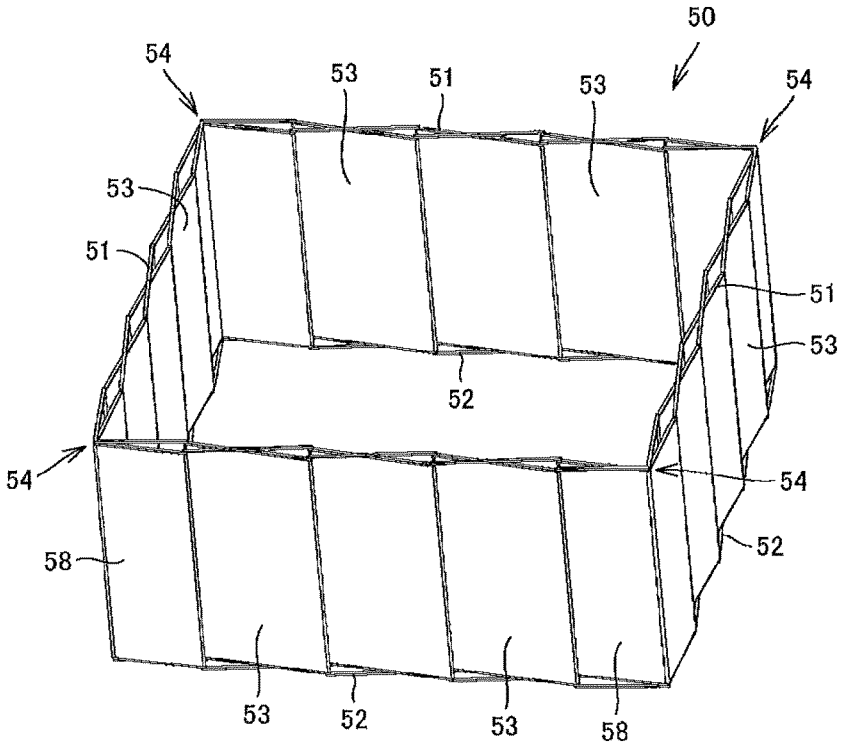
FIG. 13 is a perspective view of a further embodiment of the extendable arm structure.
Figure 14:
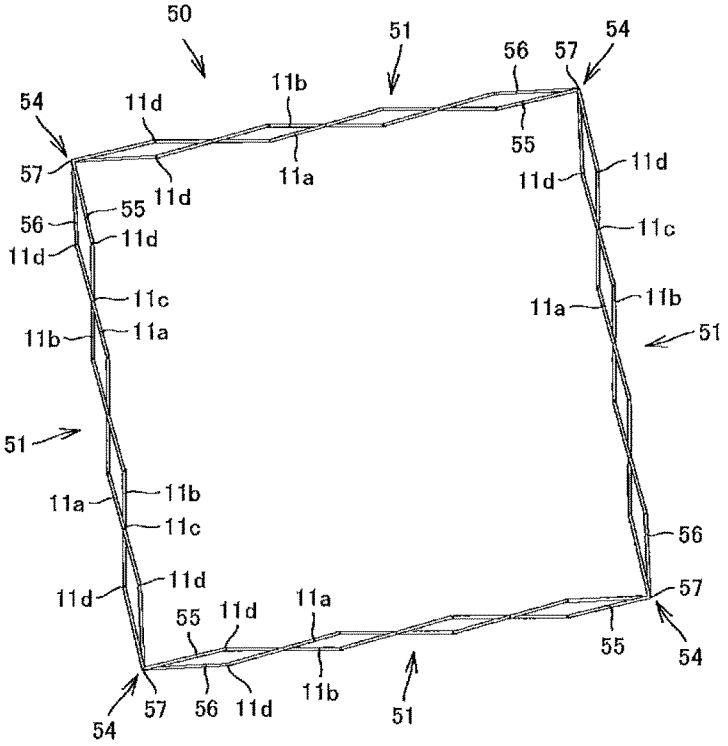
FIG. 14 is a plan view of the extendable arm structure shown in FIG. 13.
Figure 15:
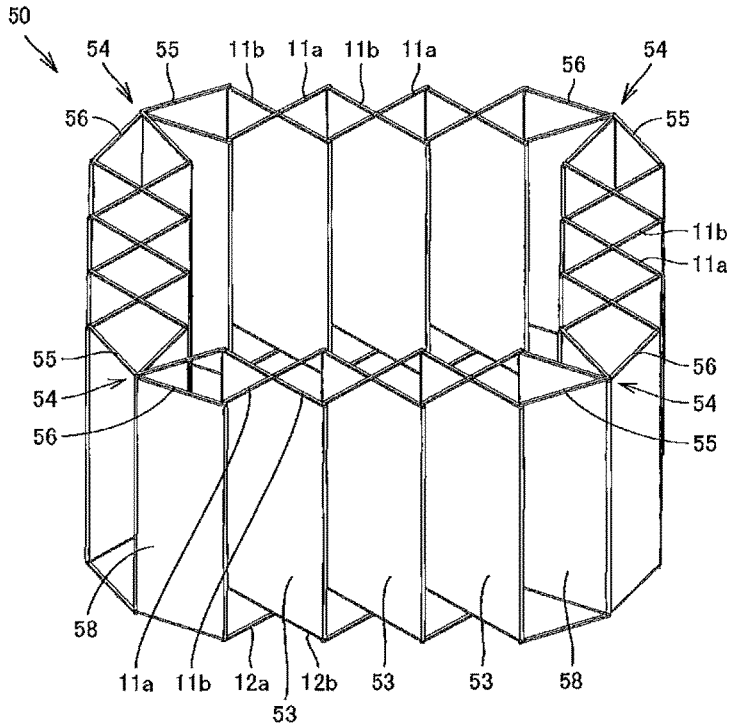
FIG. 15 is a perspective view of the extendable arm structure of FIG. 13 in a slightly contracted state.
Figure 16:
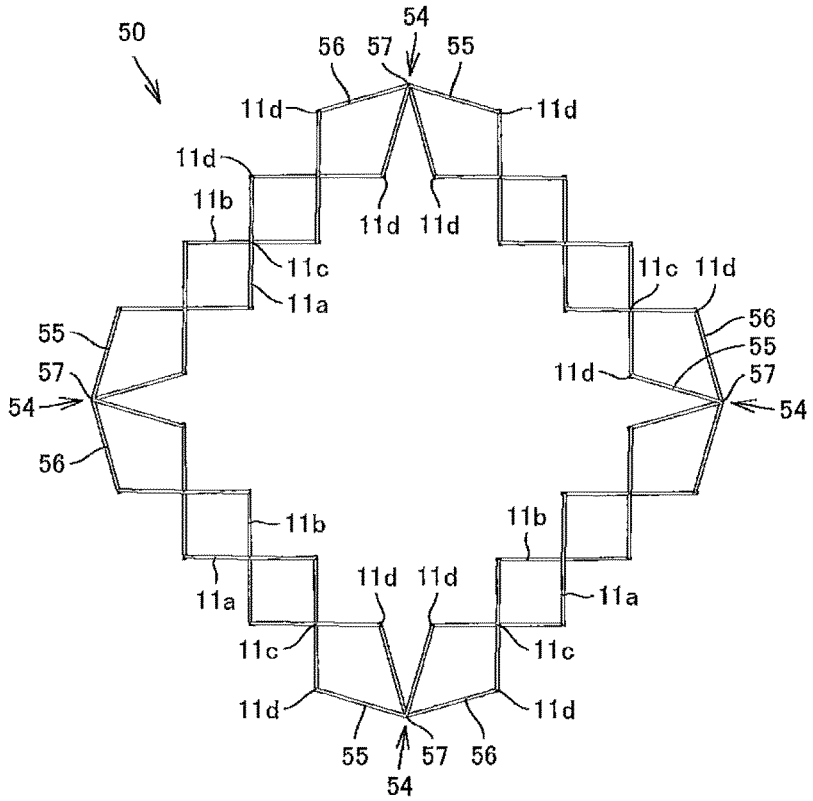
FIG. 16 is a plan view of the extendable arm structure shown in FIG. 15.
Figure 17:
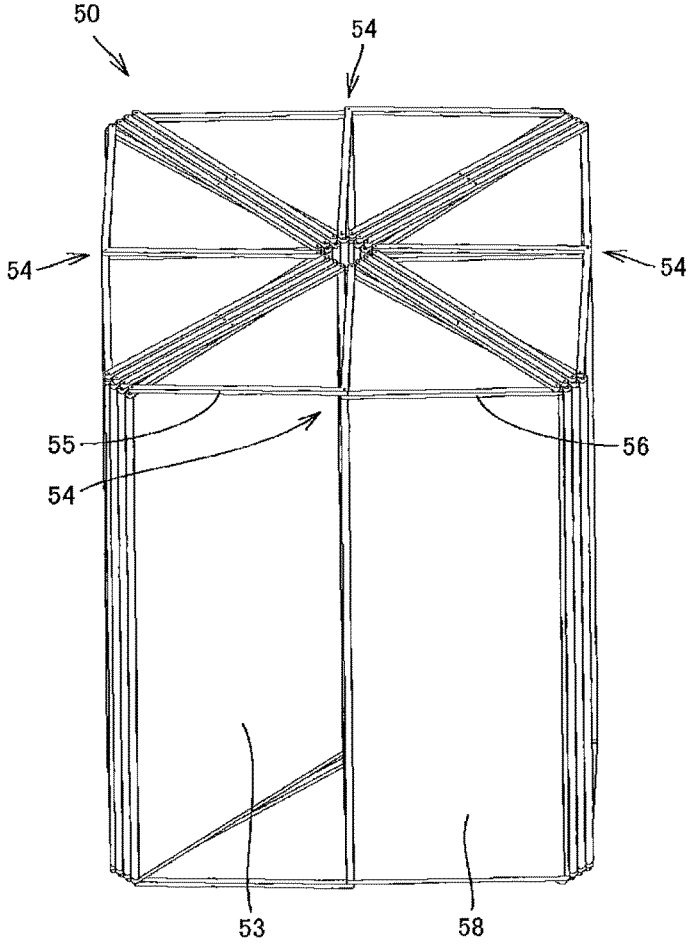
FIG. 17 is a perspective view of the extendable arm structure of FIG. 13 in a fully collapsed state.
Figure 18:
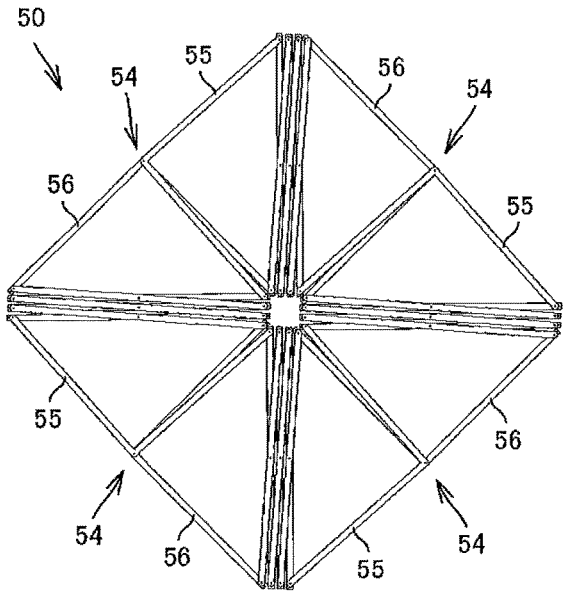
FIG. 18 is a plan view of the extendable arm structure shown in FIG. 17.
Figure 19:
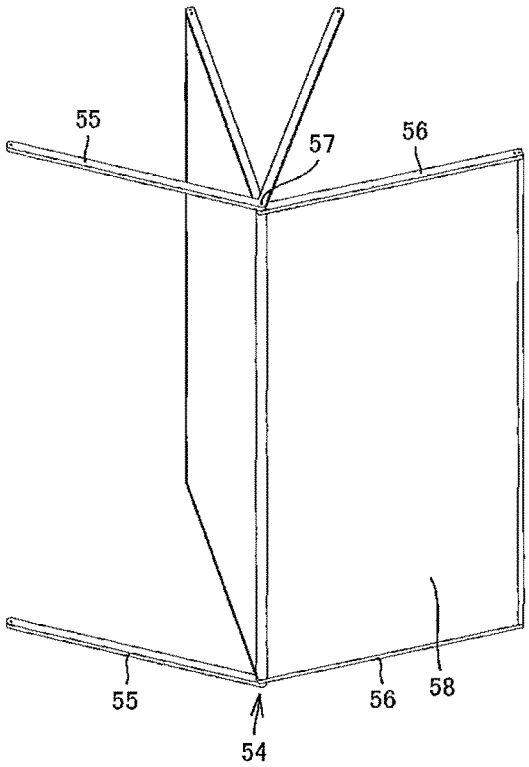
FIG. 19 is a perspective view of a corner of the extendable arm structure shown in FIG. 13.

FIGS. 13 to 19 show an extendable arm structure 50 according to a further embodiment. FIGS. 13 and 14 show the extendable arm structure 50 in an extended state. FIGS. 15 and 16 show the extendable arm structure 50 contracted to an intermediate state. FIGS. 17 and 18 show the extendable arm structure 50 in a fully collapsed state. FIG. 19 shows a corner of the polygonal extendable arm structure.

The extendable arm structure 50 shown in FIGS. 13 to 19 include a quadrilateral upper frame, a quadrilateral lower frame, and planar members 53. The quadrilateral upper frame is formed by coupling the ends of four upper extendable arms 51. The quadrilateral lower frame is formed by coupling the ends of four lower extendable arms 52. Each planar member 53 connects the entire length of the second rigid member 11*b* of the upper extendable arm 51 and the entire length of the second rigid member 12*b* of the lower extendable arm 52 in a planar fashion.

The extendable arm structure 50 further includes coupling mechanisms 54 in order to allow adjoining ones of the sides of the polygon to extend and contract together. Each coupling mechanism 54 couples two of the extendable arms 51, 52 which adjoin each other at a corner of the polygonal frame so that the two adjoining extendable arms 51, 52 can extend and contract together. In the illustrated embodiment, each coupling mechanism 54 includes a first bent member 55, a second bent member 56, and a corner coupling shaft 57 at a corner of the polygonal frame. The first bent member 55 has a bent shape and rotatably couples the inner end coupling shaft 11*d*, 12*d* of the extendable arm 51, 52 extending along one of adjoining two sides of the polygonal frame and the outer end coupling shaft 11*d*, 12*d* of the extendable arm 51, 52 extending along the other side. The second bent member 56 has a bent shape and rotatably couples the outer end coupling shaft 11*d*, 12*d* of the extendable arm 51, 52 extending along the one of the adjoining two sides of the polygonal frame and the inner end coupling shaft 11*d*, 12*d* of the extendable arm 51, 52 extending along the other side. The corner coupling shaft 57 rotatably couples the first bent member 55 and the second bent member 56 at their intersection.

As shown in FIG. 19, a planar member 58 is disposed between the upper and lower second bending members 56.

In the embodiment shown in FIGS. 13 to 19, the bend angle of the first bent members 55 and the second bent members 56 needs to be 90 degrees in order to increase or reduce the area of the quadrilateral without distorting the shape of the quadrilateral, namely in order to increase or reduce the area of the quadrilateral so that the enlarged or reduced quadrilateral is similar to the original quadrilateral.

FIGS. 13 to 19 show an example of a quadrilateral extendable arm structure. However, other polygons such as a triangle, a pentagon, and a hexagon can be formed by changing the number of extendable arms that are connected to each other. In this case, the first and second bent members need to have a predetermined bend angle in order to increase or reduce the area of the polygon without distorting the shape of the polygon, namely in order to increase or reduce the area of the polygon so that the enlarged or reduced polygon is similar to the original polygon. Specifically, the first and second bent members need to have a bend angle of A/n, where A represents the sum of interior angles of an n-gon. For example, the bend angle of the first and second bent members is 90 degrees for a quadrilateral frame, 60 degrees for an equilateral triangular frame, 108 degrees for a regular pentagonal frame, and 120 degrees for a regular hexagonal frame.

Figure 20:
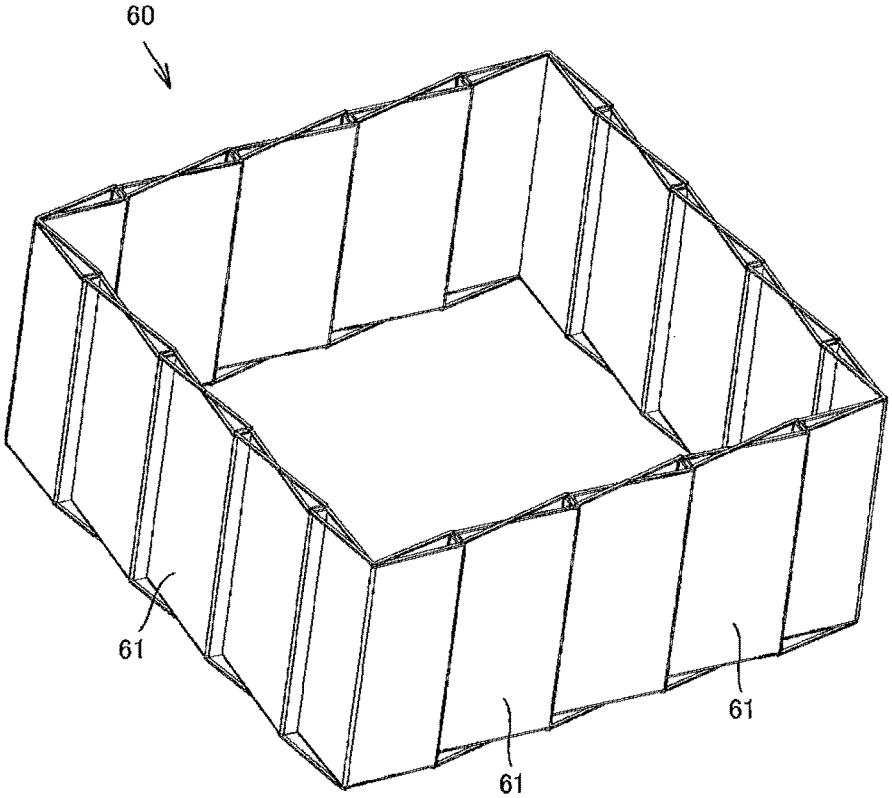
FIG. 20 is a perspective view of a still further embodiment of the extendable arm structure.
Figure 21:
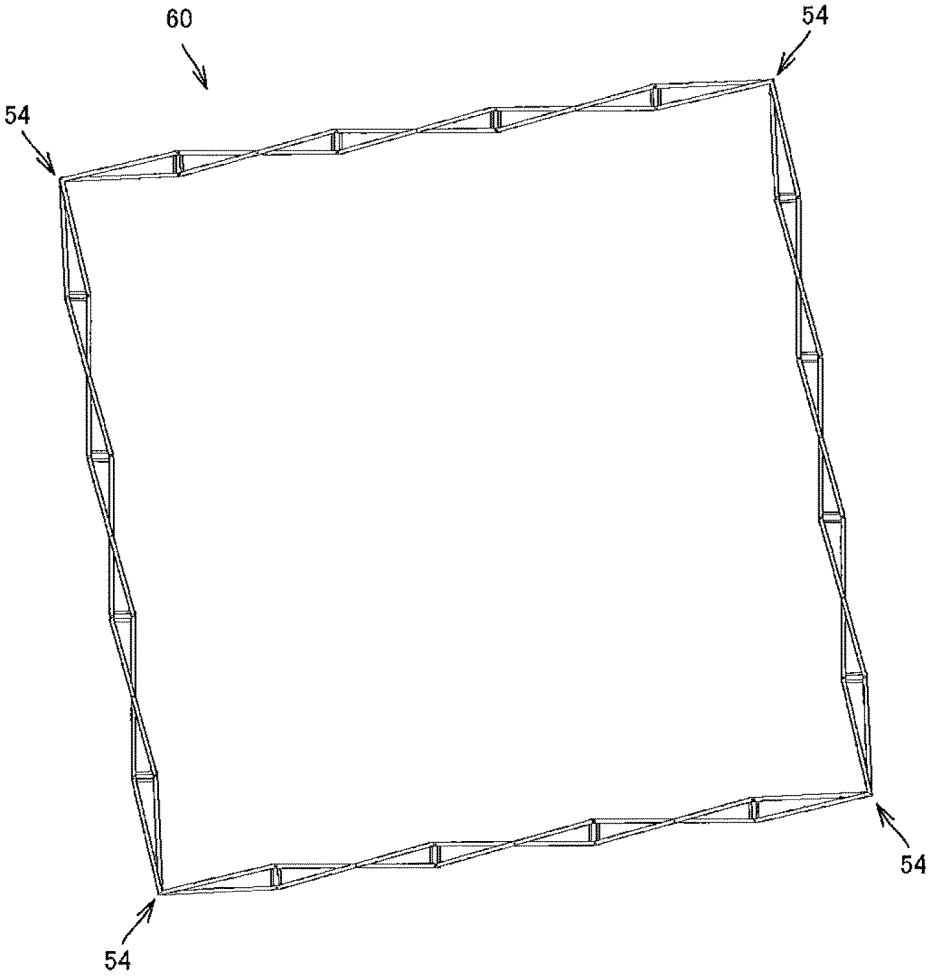
FIG. 21 is a plan view of the extendable arm structure shown in FIG. 20.
Figure 22:
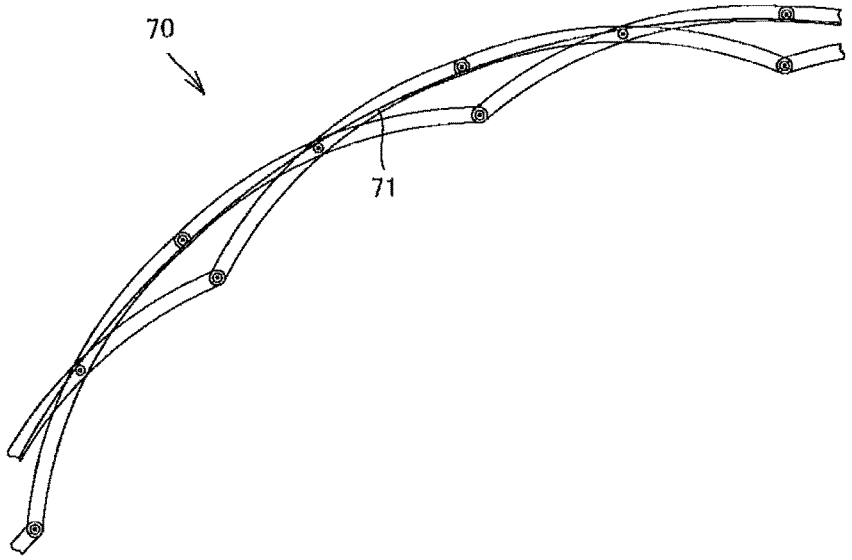
FIG. 22 is a plan view of a yet further embodiment of the extendable arm structure.

An embodiment shown in FIGS. 20 and 21 is the same as that shown in FIGS. 13 to 19 except for the shape of the planar members. Each planar member 61 of an extendable arm structure 60 shown in FIGS. 20 and 21 has a bent front end and a bent rear end as in the embodiment of FIGS. 6 and 7.

Figure 23:
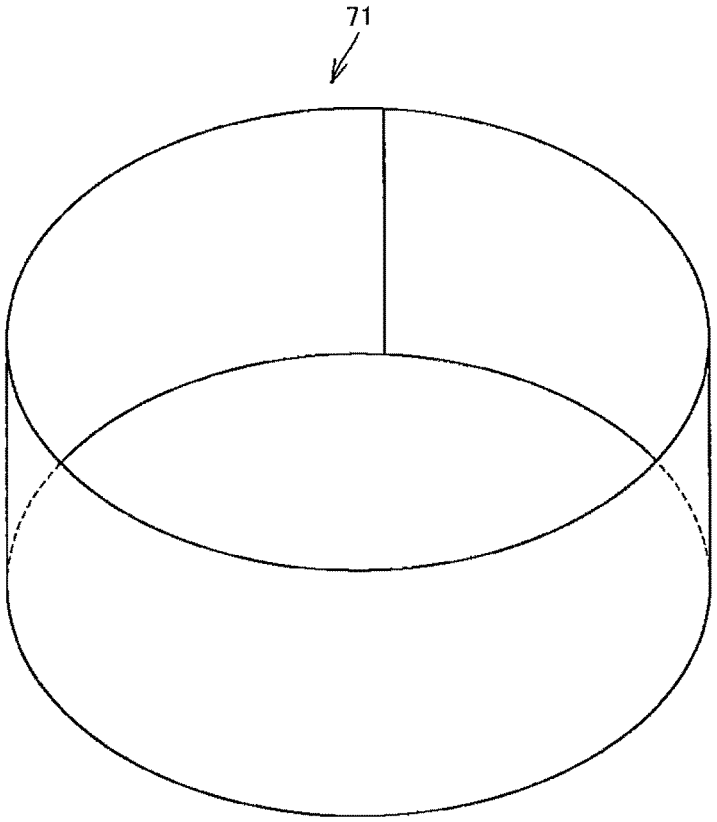
FIG. 23 is a perspective view of a cylindrical planar member.
Figure 24:
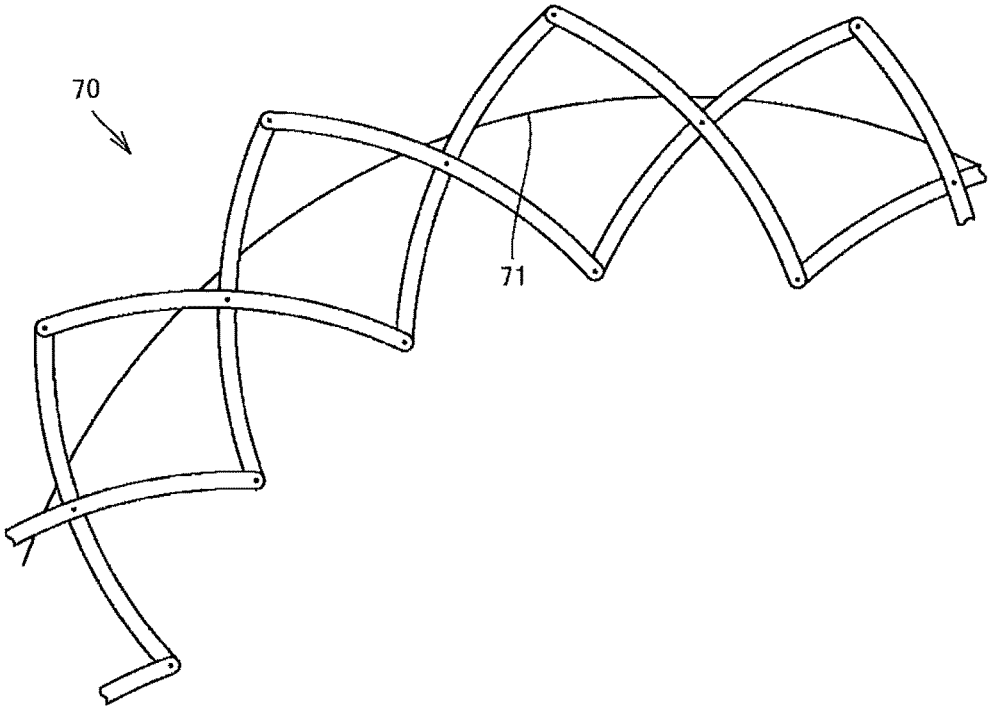
FIG. 24 is a plan view of combination of an extendable arm shown in FIG. 22 and the cylindrical planar member shown in FIG. 23.
Figure 25:
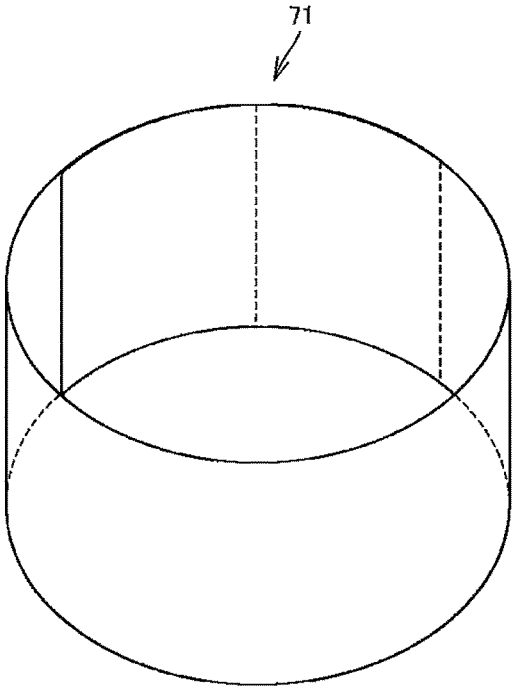
FIG. 25 is a perspective view of the cylindrical planar member shown in FIG. 23 which has a reduced diameter.

FIGS. 22 to 25 show an extendable arm structure according to a yet further embodiment. An extendable arm structure 70 shown in the figures includes an upper circular frame and a lower circular frame. The upper circular frame is formed by coupling both ends of an upper extendable arm, and the lower circular frame is formed by coupling both ends of a lower extendable arm. In the present embodiment, a planar member is a cylindrical member 71 disposed between the upper circular frame and the lower circular frame and having a variable circumferential length. In order for the cylindrical member 71 to have a variable circumferential length, one end and the other end in the circumferential direction of the cylindrical member 71 are not connected but overlap each other. As the extendable arm structure 70 is changed from an extended state shown in FIG. 22 to a contracted state shown in FIG. 24, the cylindrical member 71 is changed from the state where the cylindrical member 71 has a larger diameter as shown in FIG. 23 to the state where the cylindrical member 71 has a smaller diameter as shown in FIG. 25.

Figure 26:
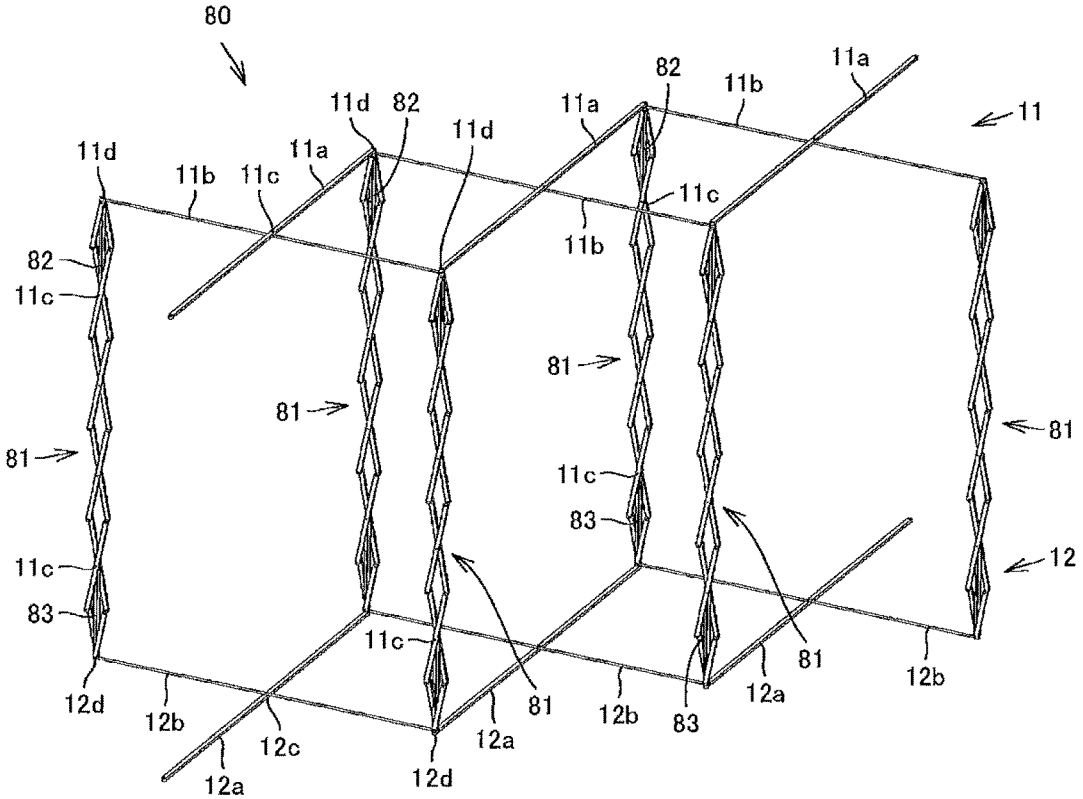
FIG. 26 is a perspective view of a yet further embodiment of the extendable arm structure.

FIG. 26 shows a yet further embodiment of the extendable arm structure. An extendable arm structure 80 shown in the figure includes an upper extendable arm 11, a lower extendable arm 12, vertical coupling members 81, and planar members, not shown. The upper extendable arm 11 is formed by coupling a plurality of cross units. The lower extendable arm 12 is formed by coupling a plurality of cross units. The vertical coupling members 81 couple the upper and lower extendable arms 11, 12 at a variable interval therebetween.

Each vertical coupling member 81 is an extendable arm formed by coupling a plurality of X-shaped cross units. One end of the vertical coupling member 81 is coupled to the end coupling shaft 11*d* of the upper extendable arm 11, and the other end thereof is coupled to the end coupling shaft 12*d* of the lower extendable arm 12.

The extendable arm structure 80 further includes upper guide members 82 and lower guide members 83 in order to allow the vertical extendable arms forming the vertical coupling members 81 to extend and contract linearly in the vertical direction. The upper guide members 82 extend downward in the vertical direction from the end coupling shafts 11*d* of the upper extendable arm 11. The lower guide members 83 extend upward in the vertical direction from the end coupling shafts 12*d* of the lower extendable arm 12. Each upper guide member 82 has a guide groove that receives the middle coupling shaft 11*c* located immediately below the upper guide member 82, and guides the middle coupling shaft 11*c* so that the middle coupling shaft 11*c* moves linearly in the vertical direction. Each lower guide member 83 guides the middle coupling shaft 11*c* located immediately above the lower guide member 83 so that the middle coupling shaft 11*c* moves linearly in the vertical direction.

Each of the planar members, not shown, connects the entire length of the second rigid member 11*b* of the upper extendable arm 11 and the entire length of the second rigid member 12*b* of the lower extendable arm 12 in a planar fashion. In the illustrated embodiment, since the interval between the upper and lower extendable arms 11, 12 is variable, the planar members also have a variable vertical height. As an example of the structure for the planar member to have a variable vertical height, the planar member may have an accordion shape. Alternatively, a sheet take-up roll may be attached along the upper or lower second rigid member 11*b*, 12*b* so that a flexible sheet is pulled out from or taken up by the take-up roll.

Figure 27A:
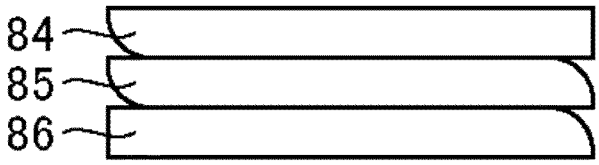
FIGS. 27A to 27C show an example of a variable height planar member, where
Figure 27B:
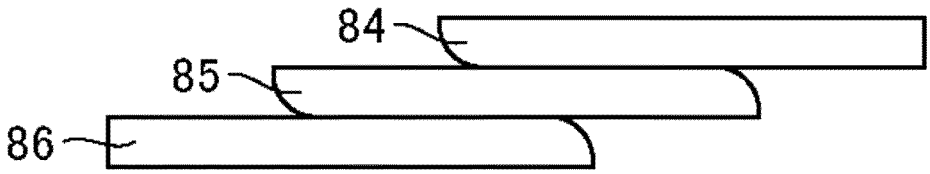
Figure 27C:
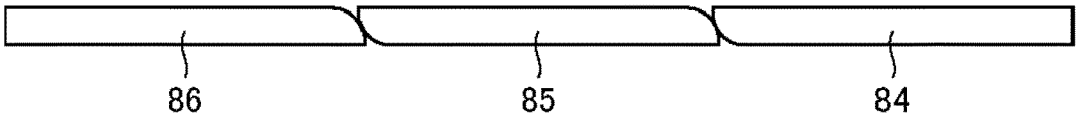

As another example, as shown in FIG. 27, the planar member may be formed by a plurality of plate materials 84, 85, 86. In this case, the plurality of plate materials 84, 85, 86 can be located at a folded position (FIG. 27A) where the plurality of plate materials 84, 85, 86 completely overlap each other and a deployed position (FIG. 27C) where the plurality of plate materials 84, 85, 86 are connected on the same plane. FIG. 27B shows an intermediate position between the folded position and the deployed position. In order to smoothly move the plurality of plate materials 84, 85, 86 from the folded position to the deployed position, it is preferable that the plate materials 84, 85, 86 have chamfered ends.

Figure 28:
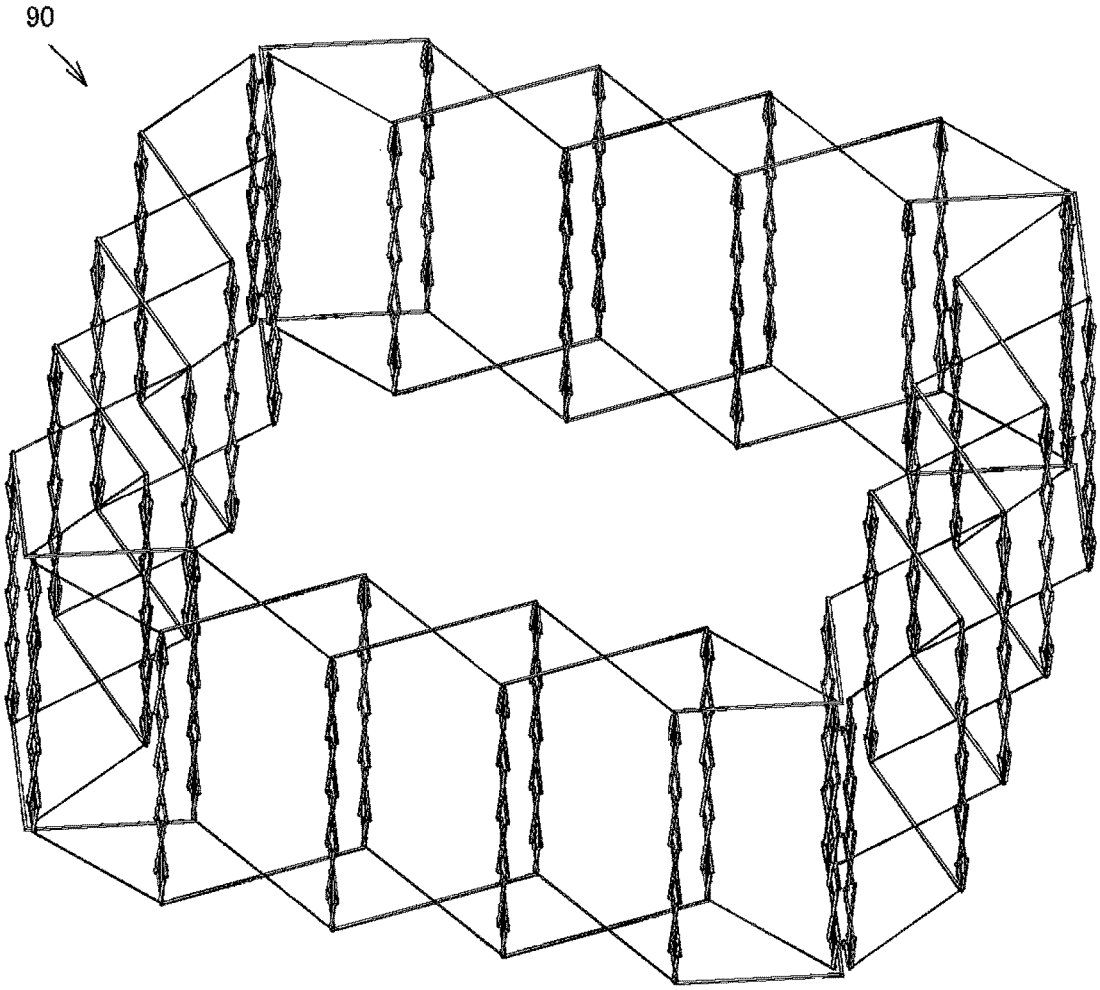
FIG. 28 is a perspective view of a polygonal extendable arm structure formed by using a plurality of the extendable arms shown in FIG. 26.

FIG. 28 is a perspective view of a polygonal extendable arm structure formed by using a plurality of the extendable arms shown in FIG. 26. An extendable arm structure 90 shown in FIG. 28 is the same as the extendable arm structure 50 shown in FIG. 13 except that the vertical coupling members and the planar members have a variable height.

Figure 29:
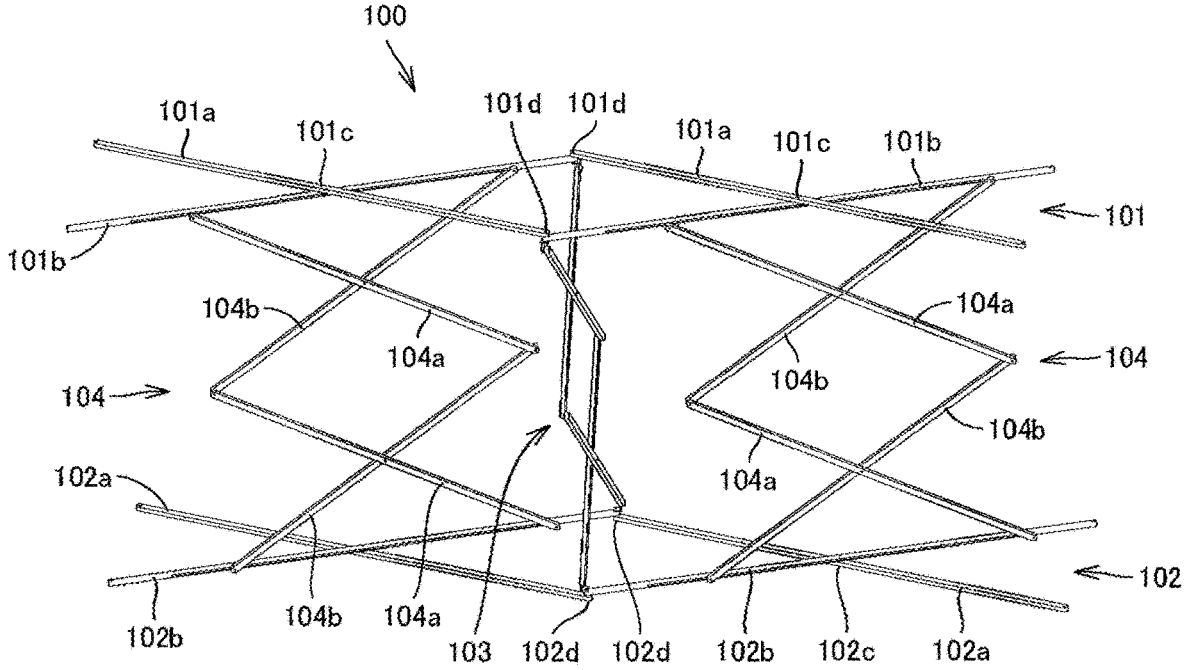
FIG. 29 is a perspective view of a yet further embodiment of the extendable arm structure.

FIG. 29 shows an extendable arm structure according to a yet further embodiment. An extendable arm structure 100 shown in the figure is configured so that the interval between an upper extendable arm 101 and a lower extendable arm 102 changes as the upper extendable arm 101 and the lower extendable arm 102 extend and contract. In order to implement this configuration, the extendable arm structure 100 includes a first vertical extendable arm 103 as a vertical coupling member that couples the upper and lower extendable arms 101, 102.

The upper extendable arm 101 includes cross units each formed by a first rigid member 101*a* and a second rigid member 101*b* which are pivotally coupled via a middle coupling shaft 101*c*. Adjacent two of the cross units are pivotally coupled via two end coupling shafts 101*d*.

Similarly, the lower extendable arm 102 includes cross units each formed by a first rigid member 102*a* and a second rigid member 102*b* which are pivotally coupled via a middle coupling shaft 102*c*. Adjacent two of the cross units are pivotally coupled via two end coupling shafts 102*d*.

The first vertical extendable arm 103 is an extendable arm including X-shaped cross units. The upper end of the first vertical extendable arm 103 is pivotally coupled to the two end coupling shafts 101*d* of the upper extendable arm 101, and the lower end of the first vertical extendable arm 103 is pivotally coupled to the two end coupling shafts 102*d* of the lower extendable arm 102.

The extendable arm structure 100 according to the illustrated embodiment further includes second vertical extendable arms 104. Each second vertical extendable arm 104 supports the second rigid member 101*b* of the upper extendable arm 101 and the second rigid member 102*b* of the lower extendable arm 102 such that these second rigid members 101*b*, 102*b* are parallel to each other. Each second vertical extendable arm 104 also makes the interval between the second rigid member 101*b* and the second rigid member 102*b* variable.

The second vertical extendable arm 104 is an extendable arm including X-shaped cross units each formed by a first rigid member 104*a* and a second rigid member 104*b*. The upper ends of the first rigid member 104*a* and the second rigid member 104*b* of the upper cross unit are coupled to the second rigid member 101*b* of the upper extendable arm 101. The lower ends of the first rigid member 104*a* and the second rigid member 104*b* of the lower cross unit are coupled to the second rigid member 102*b* of the lower extendable arm 102. This coupling will be described below.

The upper end of the upper first rigid member 104*a* of the second vertical extendable arm 104 is pivotally coupled to the second rigid member 101*b* of the upper extendable arm 101 at a fixed point. The upper end of the upper second rigid member 104*b* of the second vertical extendable arm 104 is pivotally coupled to the second rigid member 101*b* of the upper extendable arm 101 such that the upper end of the upper second rigid member 104*b* can slide along the second rigid member 101*b*. The lower end of the lower second rigid member 104*b* of the second vertical extendable arm 104 is pivotally coupled to the second rigid member 102*b* of the lower extendable arm 102 at a fixed point. The lower end of the lower first rigid member 104*a* of the second vertical extendable arm 104 is pivotally coupled to the second rigid member 102*b* of the lower extendable arm 102 such that the lower end of the lower first rigid member 104*a* can slide along the second rigid member 102*b*.

Although not shown in the figure, a variable height planar member is disposed between the entire length of the second rigid member 101*b* of the upper extendable arm 101 and the entire length of the second rigid member 102*b* of the lower extendable arm 102. For example, the variable height planar member may be an accordion-shaped sheet member, a sheet member on a roll, a structure formed by a plurality of plate materials, etc.

The extendable arm structure 100 of FIG. 29 operates as follows. As the upper and lower extendable arms 101, 102 extend, the first vertical extendable arm 103 extends with the upper and lower extendable arms 101, 102, and the second vertical extendable arms 104 also extend accordingly. As the upper and lower extendable arms 101, 102 contract, the first vertical extendable arm 103 contracts with the upper and lower extendable arms 101, 102, and the second vertical extendable arms 104 also contract accordingly.

In the embodiment of FIG. 29, the upper and lower extendable arms and the vertical extendable arms extend and contract together. However, in the case where the upper and lower ends of the vertical extendable arm are coupled to two middle coupling shafts or two end coupling shafts which are adjacent to each other in the longitudinal direction of the upper and lower extendable arms, the vertical extendable arm contracts as the upper and lower extendable arms extend, and the vertical extendable arm extends as the upper and lower extendable arms contract.

Figure 30:
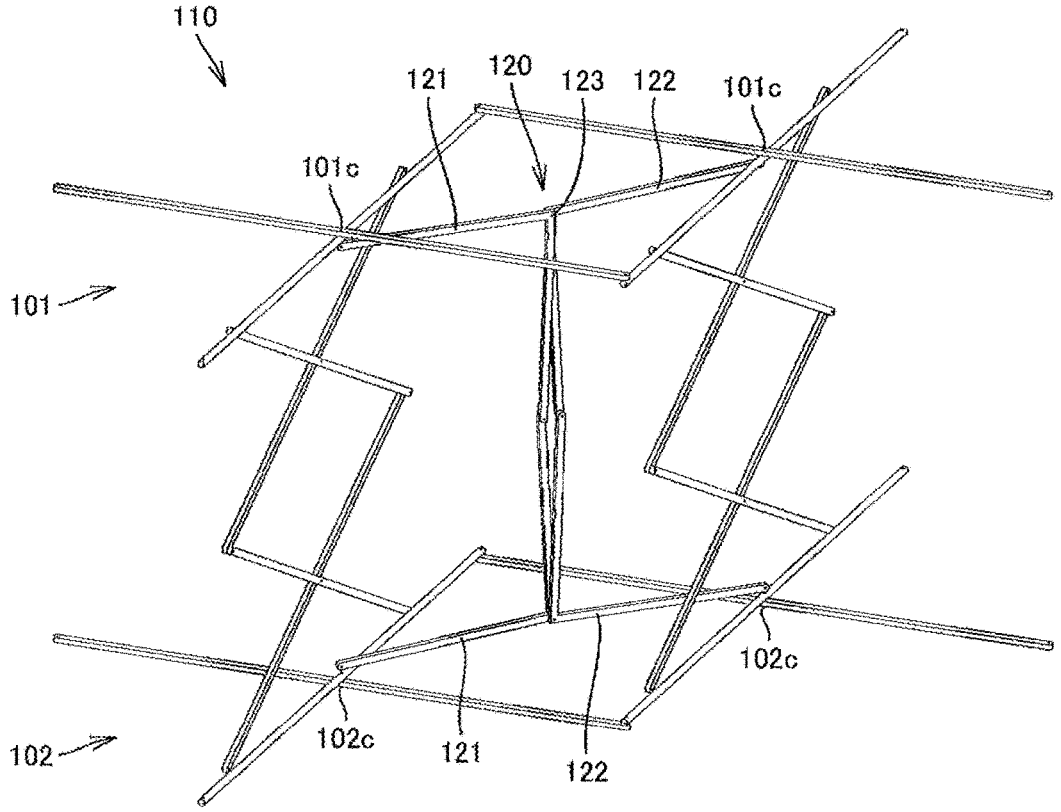
FIG. 30 is a perspective view of a yet further embodiment of the extendable arm structure.

FIG. 30 shows an extendable arm structure 110 according to a yet further embodiment. The extendable arm structure 110 shown in FIG. 30 is the same as the extendable arm structure 110 shown in FIG. 29 except for the shape of the first vertical extendable arm.

A first vertical extendable arm 120 of the extendable arm structure 110 shown in the figure includes two bent units. Each bent unit has a first bent rigid member 121 bent in a V-shape, a second bent rigid member 122 bent in a V-shape that opens in the opposite direction from the V-shape of the first bent rigid member 121, and a bend part coupling shaft 123 that pivotally couples the bend part of the first bent rigid member 121 and the bend part of the second bent rigid member 122. The ends of the two bent units are pivotally coupled to each other.

The upper end of the first vertical extendable arm 120 is pivotally coupled to two middle coupling shafts 101*c* that are adjacent to each other in the longitudinal direction of the upper extendable arm 101. The lower end of the first vertical extendable arm 120 is pivotally coupled to two middle coupling shafts 102*c* that are adjacent to each other in the longitudinal direction of the lower extendable arm 102.

According to the extendable arm structure 110 shown in FIG. 30, the upper and lower extendable arms and the vertical coupling member extend and contract together, as in the extendable arm structure 100 shown in FIG. 29.

Although some embodiments of the present invention are described above with reference to the drawings, the present invention is not limited to the illustrated embodiments. Various modifications or variations can be made to the illustrated embodiments without departing from the spirit and scope of the present invention.

For example, the first vertical extendable arm 103 shown in FIG. 29 or the first vertical extendable arm 120 shown in FIG. 30 may be applied to the embodiment of FIG. 26 or 28.

The extendable arm structure according to the present invention has high use value in various applications of the industry. For example, the extendable arm structure according to the present invention can be advantageously used in many applications such as partitions, architectural structures, containers, exhibits, pavilions, play equipment, assembling toys, learning materials, decorations, art objects, furniture, enclosures for animals such as pets, bathroom stalls, dressing stalls, shower stalls, above-ground buildings, underground buildings, underwater buildings, aerial buildings, temporary houses, warehouses, vegetable factories, tents, zoos and botanical gardens, space stations, various facilities on planets, satellites, antennae, and solar array wings.

The invention claimed is:

1. An extendable arm structure, comprising:

an upper extendable arm and a lower extendable arm which extend parallel in a same direction, each of the extendable arms comprises:

a plurality of X-shaped cross units each formed by pivotally coupling a first extension member and a second extension member via a middle coupling shaft; and two end coupling shafts that pivotally couple ends of adjacent ones of the cross units;

a plurality of vertical coupling members that couple the upper and lower extendable arms; and a plurality of planar members that close, in a planar fashion, a space between the second extension members of the upper extendable arm and the second extension members of the lower extendable arm, wherein each of the planar members connects an entire length of the second extension member of the upper extendable arm and an entire length of the second extension member of the lower extendable arm.

2. The extendable arm structure according to claim 1, wherein the vertical coupling members of the plurality of vertical coupling members couple the upper and lower extendable arms at a variable interval therebetween.

3. The extendable arm structure according to claim 2, wherein at least one planar member of the plurality of planar members has a variable vertical height.

4. The extendable arm structure according to claim 3, wherein at least one planar member of the plurality of planar members is a single sheet material.

5. The extendable arm structure according to claim 3, wherein at least one planar member of the plurality of planar members is formed by a plurality of plate materials, and the plurality of plate materials are configured so that the plurality of plate materials can be in a folded position where the plurality of plate materials overlap each other and in a deployed position where the plurality of plate materials are connected on a same plane.

6. The extendable arm structure according to claim 1, further comprising:

an upper frame formed by coupling ends of a plurality of the upper extendable arms; and a lower frame formed by coupling ends of a plurality of the lower extendable arms.

7. The extendable arm structure according to claim 1, further comprising:

an upper circular frame formed by coupling both ends of the upper extendable arm; and a lower circular frame formed by coupling both ends of the lower extendable arm.

8. The extendable arm structure according to claim 1, wherein the planar members have bent ends that are configured to contact a planar portion of an adjacent planar member in one or more of a folded state or a deployed state.

9. The extendable arm structure according to claim 1, wherein the first extension members and the second extension members are curved.

* * * * *